United States Patent [19]

Pruonto

[11] Patent Number: 4,562,786

[45] Date of Patent: Jan. 7, 1986

[54] COLLAPSIBLE PONTOON BOAT

[76] Inventor: Gene M. Pruonto, P.O. Box 69, Duncansville, Pa. 16635

[21] Appl. No.: 593,904

[22] Filed: Mar. 27, 1984

[51] Int. Cl.[4] ..... B63B 1/12; B63B 7/08

[52] U.S. Cl. ..... 114/61; 114/361; 135/88

[58] Field of Search ..... 114/61, 354, 352, 361, 114/266; 441/40, 44, 45, 38, 4–6; 52/468; 135/88, 101

[56] References Cited

U.S. PATENT DOCUMENTS

| | | | |
|---|---|---|---|
| 2,513,764 | 7/1950 | Ahe | 114/361 |
| 2,714,387 | 8/1955 | Meldrum | 114/361 |
| 3,066,451 | 12/1962 | Petty | 52/468 |
| 3,131,665 | 5/1964 | Kiekhaefer | 441/45 X |
| 3,473,502 | 10/1969 | Wittkamp | 114/61 |
| 3,614,937 | 10/1971 | Schulman | 114/292 |

*Primary Examiner*—Sherman D. Basinger

*Attorney, Agent, or Firm*—Dennison, Meserole, Pollack & Scheiner

[57] ABSTRACT

A collapsible pontoon boat includes a deck assembly and a plurality of inflatable pontoons for receiving and supporting the deck assembly. The deck assembly includes a plurality of deck panels, and end rails and side rails assemblable into a deck frame. The deck panels are secured to the side rails and end rails and to interposed support members to form the deck assembly, and the pontoons are secured to the deck assembly, underlying the side rails.

22 Claims, 13 Drawing Figures

FIG. 10
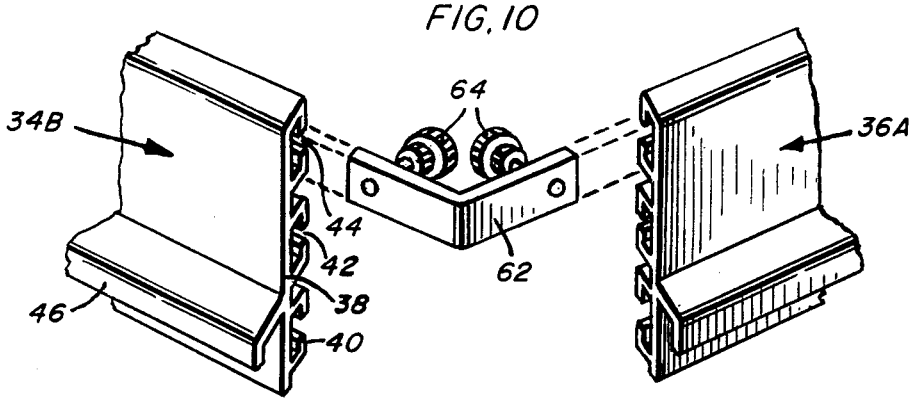
FIG. 11
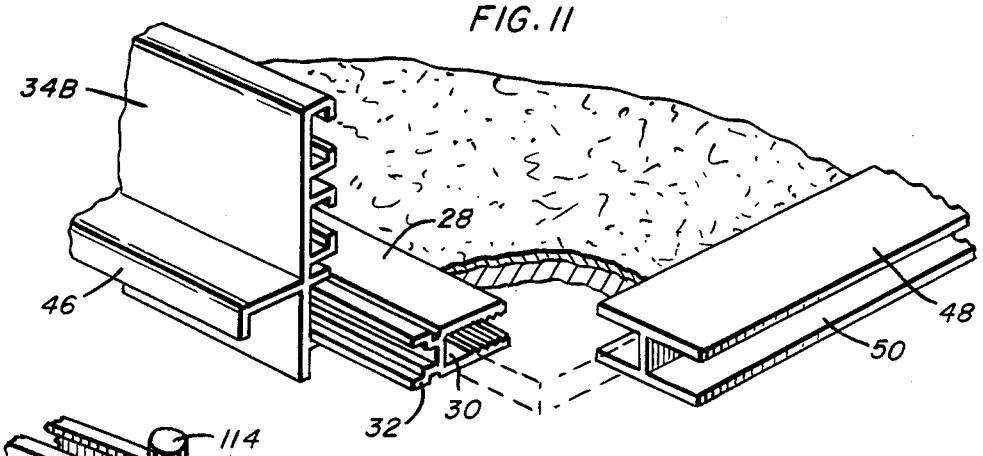
FIG. 12
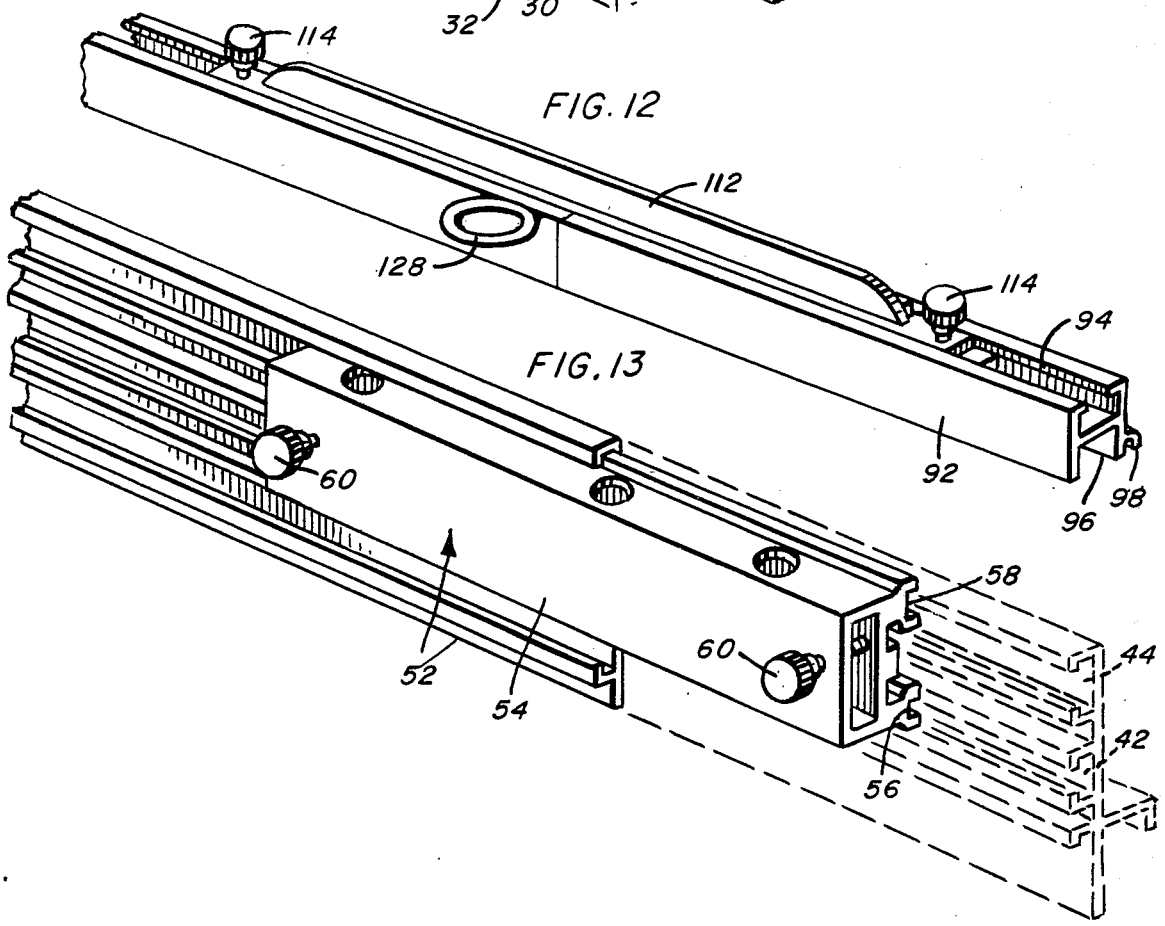
FIG. 13

COLLAPSIBLE PONTOON BOAT

BACKGROUND OF THE INVENTION

The present invention relates to a boat structure, and more particularly to a pontoon boat structure which is completely collapsible or disassemblable.

Pontoon boats have enjoyed popularity in recent years as stable and comfortable platforms for carrying groups of people. However, their popularity has been limited by the weight and bulk of the conventional pontoon boat structure which makes them difficult to store and to transport. While attempts have been made to develop a collapsible pontoon boat structure, none has been completely successful in providing the necessary rigidity in structure to make the boat safe while at the same time allowing for easy construction and complete portability.

SUMMARY OF THE INVENTION

It is an object of the invention to provide a collapsible pontoon boat which is rigid and safe.

It is another object of the present invention to provide a boat as lightweight as possible without sacrificing structural strength.

It is another object of the present invention to provide a construction which facilitates quick and easy assembly and disassembly of the boat without tools.

It is a further object of the present invention to enable easy transport of the collapsed boat parts.

In order to achieve these and other objects, the present invention provides for a collapsible pontoon boat structure including a deck structure comprising a plurality of deck panels with I-shaped support members therebetween, opposed side rails, and opposed end rails. The deck panels releasably interconnect with the end rails, side rails, and support members by a tongue and groove system. The side rails releasably connect to the end rails to form a rigid frame.

The boat further includes a pair of pontoons underlying the formed deck structure adjacent the opposed side rails. Each pontoon has a continuous outside flap and a plurality of inside flaps. The outside flap connects to the adjoining side rail along the length of the boat; the inside flaps connect to the support members or side rails on the underside of the boat.

The boat may also include at least two hand rails, on opposite sides of the boat, with pickets unfolding from the hand rails and secured in the side rails.

The boat structure will be readily understood by referring to the following description and the accompanying drawings, in which:

BRIEF DESCRIPTION OF THE DRAWINGS

FIG. 10 is an enlarged exploded perspective view of a side rail, end rail and corner connector of the boat;

FIG. 11 is an enlarged perspective view of a deck panel, side rail, and support member;

FIG. 12 is an enlarged perspective view of a hand rail section and hand rail connector;

FIG. 13 is an enlarged perspective view of a side rail and center connector.

DESCRIPTION OF THE PREFERRED EMBODIMENTS

Figure 1:
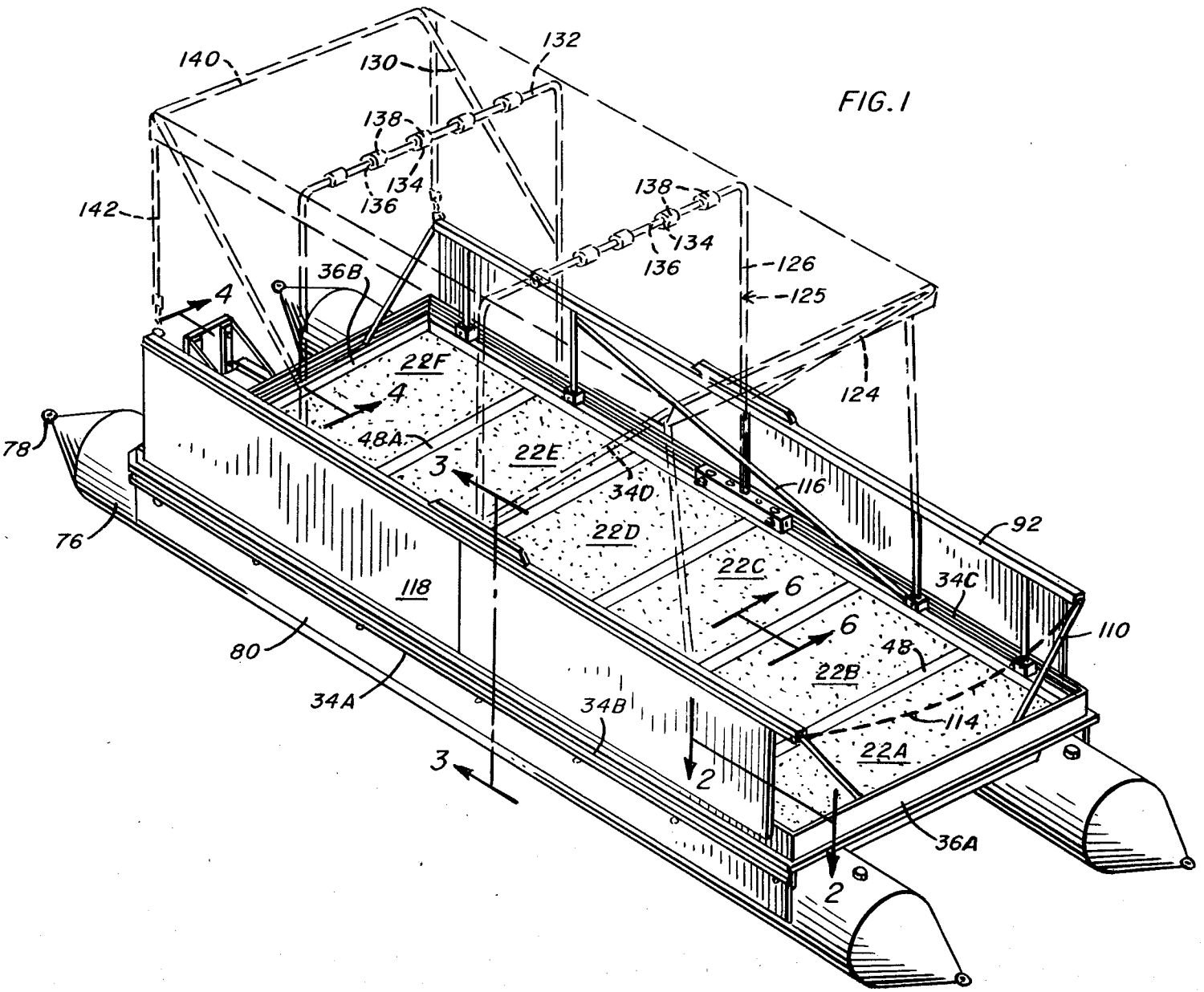
FIG. 1 is a perspective view of a boat according to the present invention.

The basic construction unit of the pontoon boat of the present invention is deck structure 20 shown in FIG. 1. Deck structure 20 includes six deck panels 22A through 22F, each deck panel typically being constucted of marine grade plywood edged all around in aluminum for protection. The exposed plywood is preferably covered with a waterproof material, such as outdoor carpeting 24.

Figure 6:
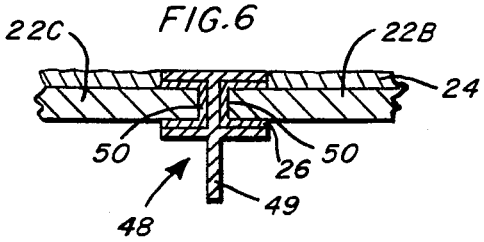
FIG. 6 is an enlarged cross-sectional detail view along line 6—6 in FIG. 1.

The edges of the plywood facing the inside of the boat are protected with channel shaped aluminum extrusions 26 as shown in FIG. 6. The plywood edges facing the outside of the boat are protected with aluminum connector extrusion 28 shown best in FIGS. 3 and 12. Connector 28 is formed with two full length oppositely directed portions, one portion defining an inwardly directed channel 30 receiving the plywood edge and the other portion defining an outwardly directed undercut tongue 32 separated from the channel 30 by a barrier formed by the bottom wall of channel 30. End panels 22A and 22F will have three edges facing the outside of the boat, while the remaining deck panels 22B, 22C, 22D and 22E will have two edges facing the outside of the boat and two edges facing the inside of the boat.

Figures 2, 3:
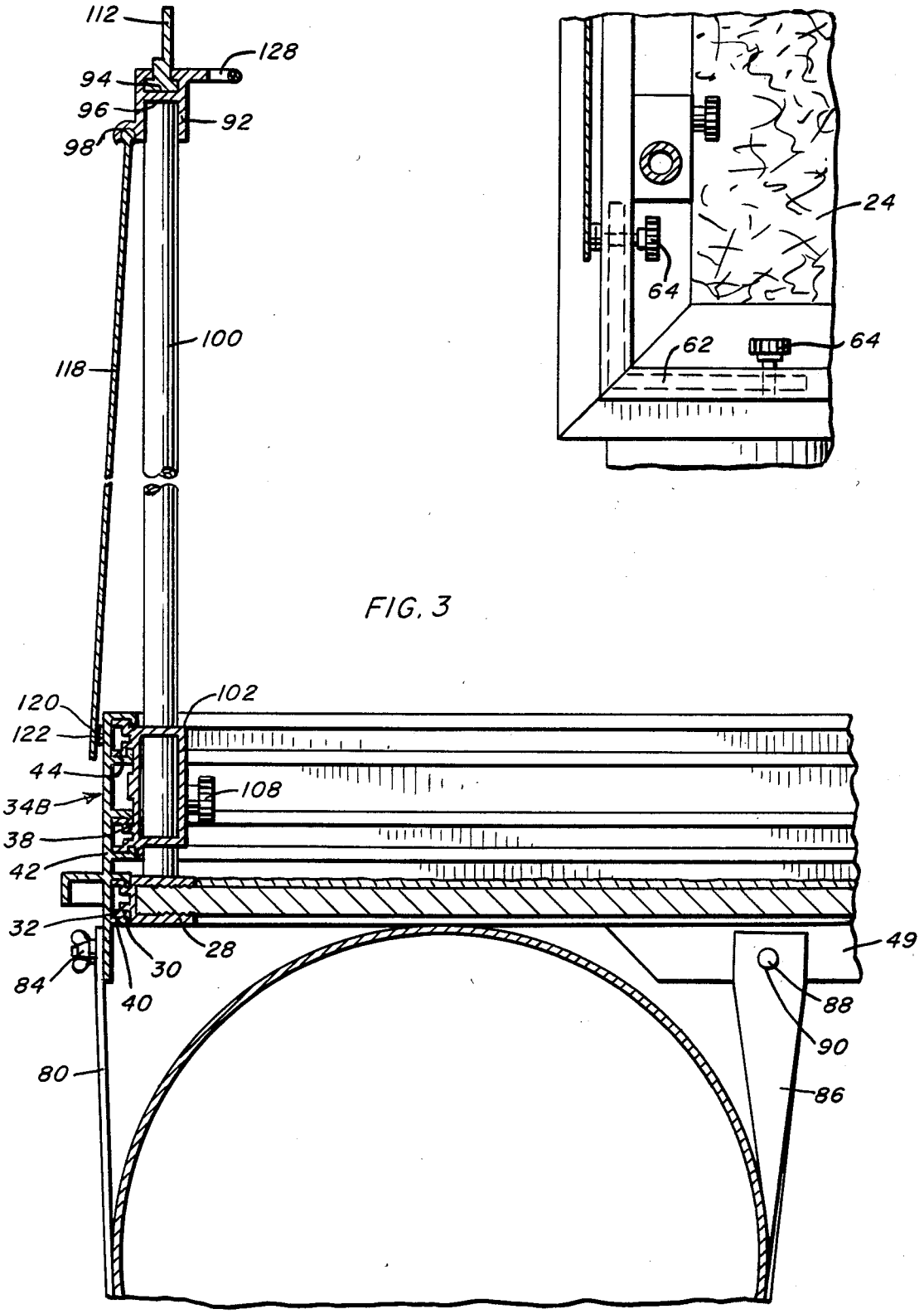
FIG. 2 is an enlarged sectional detail taken substantially on a plane passing along line 2—2 in FIG. 1.
FIG. 3 is an enlarged cross-sectional detail view along line 3—3 in FIG. 1.

Channel 30 which receives the plywood is internally ribbed longitudinally as shown in cross-section in FIG. 3. This ribbing serves to better grip the plywood and to retain a waterproof adhesive for permanently securing the plywood in the channel. Moreover, each channel 30 or channel portion is tapered laterally, the deepest point in the channel being wider and slightly wider than the plywood, in order to accommodate potential minor swelling of the plywood when wet.

The sides of the boat are formed from four side rails 34A, 34B, 34C and 34D, side rails 34A and 34B forming one side of the boat, and side rails 34C and 34D forming the other side of the boat. The ends of the boat are formed from end rails 36A and 36B. The side rails and end rails all have the same general configuration, which can be seen in FIGS. 3, 10, 11 and 13. These rails include a vertical support 38 having three horizontal, vertically spaced C-channels 40, 42 and 44 integral therewith and projecting inwardly therefrom, and a horizontal strengthening flange 46 projecting outwardly therefrom. This flange 46 will also function as a rub rail for the side of the assembled boat. It should be noted that C-channels 40, 42 and 44 all include inwardly projecting lips. The lowermost C-channel 40 is adapted to slidably receive the undercut tongue 32 of connector 28 to secure the deck panels 22A–22F in the side rails 34A–34D and end rails 36A–36B. Moreover, because connector 28 has the deck engaging channel portion 30 and tongue forming portion 32 being oppositely directed and remote, the plywood and the rails are kept isolated. In this way swelling of the plywood will not affect the tongue and groove connection between the deck and the rail. Unequal expansion or contraction of the metal and wood caused by variations in temperature will also not affect this connection. The function of channels 42 and 44 will become apparent as other features of the invention are described.

Located between adjacent deck panels are supports 48. These supports 48 which are generally I-shaped, define oppositely opening channels 50 designed to receive and cooperate with extruded edge protectors 26 which serve as the inside edges of the deck panels 22A–22E. As will be noted in FIG. 6, the central vertical web 49 of each support 48 depends below the lowermost legs of channels 50 a distance at least equal to the height of the channels 50 to define a strengthening rib. Each support 48, so formed, functions as a structure rigidifying cross beam. Web 49 is cut back at the ends of the supports to allow space for mounting the pontoons.

As noted previously, the deck construction shown in FIG. 1 includes two end rails, six deck panels, five supports between the deck panels and four side rails. In order to keep the size of the boat kit small when broken down, it is desired to keep the length of the side rails relatively short, often shorter than the length of the boat. Normally, the side rails will be no longer than the width of the boat. In the embodiment shown, each side rail is long enough to accommodate three deck panels and their supports. In order to provide a boat comprised of six deck panels, two side rails, each holding three deck panels, must be longitudinally interconnected. (The panels themselves are interconnected by supports 48). The side rail interconnection is done by means of a lateral connector 52 shown in FIG. 13. The connector 52 includes an elongated block body 54, and two full length undercut tongue structures 56 and 58 projecting from one face of block body 54. These tongue structures 56 and 58 are designed to slide within C-channels 42 and 44 of a pair of adjacent rails and to bridge the point where the two side rails meet. Two thumbscrews 60 are threaded through block body 54 and when tightened will abut vertical supports 38 of the aligned side rails 34A and 34B or 34C and 34D, between channels 42 and 44 in order to secure center connector 52 in place.

Side rails 34A–34D are secured to end rails 36A–36B at the corners of the boat by means of 90° connectors 62, shown in FIGS. 2 and 10, having a thumbscrew 64 threaded through each leg of connector 62. In assembling the frame, a connector 62 is normally inserted into top channel 44 at each end of end rails 36A–36B, slid as far as possible in order to form a corner on the rail, and secured by tightening thumbscrew 64 to engage the inner end thereof against the inner wall of the channel. The other leg of connector 62 can then be inserted into top channel 44 of an adjoining side rail 34A–34D and secured by similarly tightening the corresponding thumbscrew to form a secure corner. It will be recognized that the inwardly directed flanges or lips of the C-shaped channels 44 retain the connector legs against lateral disengagement.

Alternatively, an over-center connector attached to the outside of the end rails and side rails can be used to secure the corners.

Figure 4:
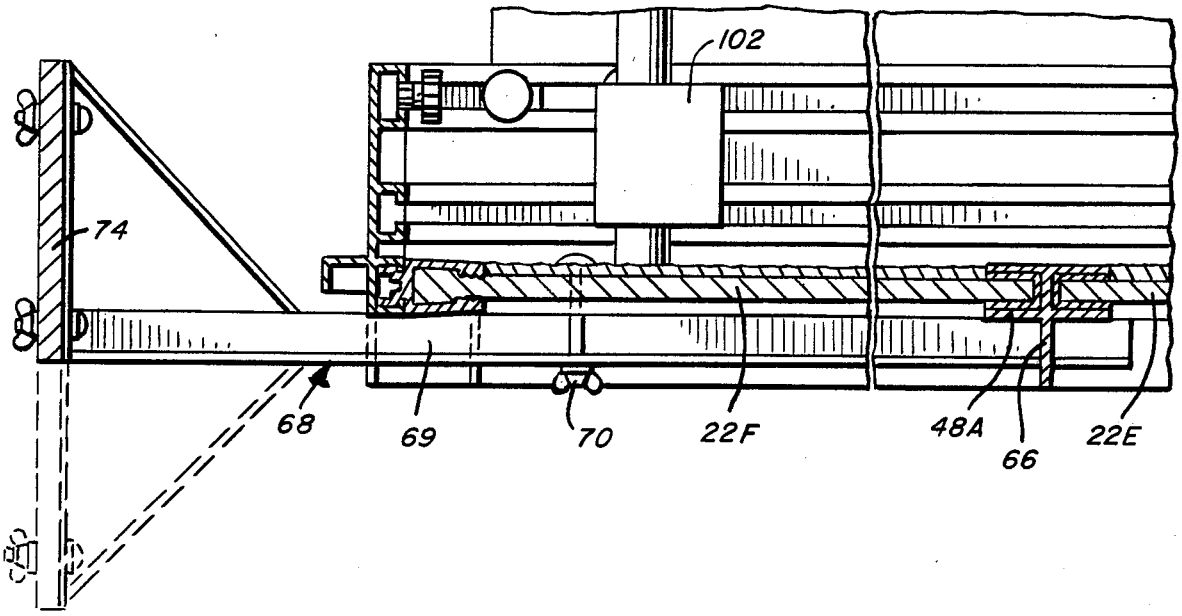
FIG. 4 is an enlarged cross-sectional detail view along line 4—4 in FIG. 1.
Figure 5:
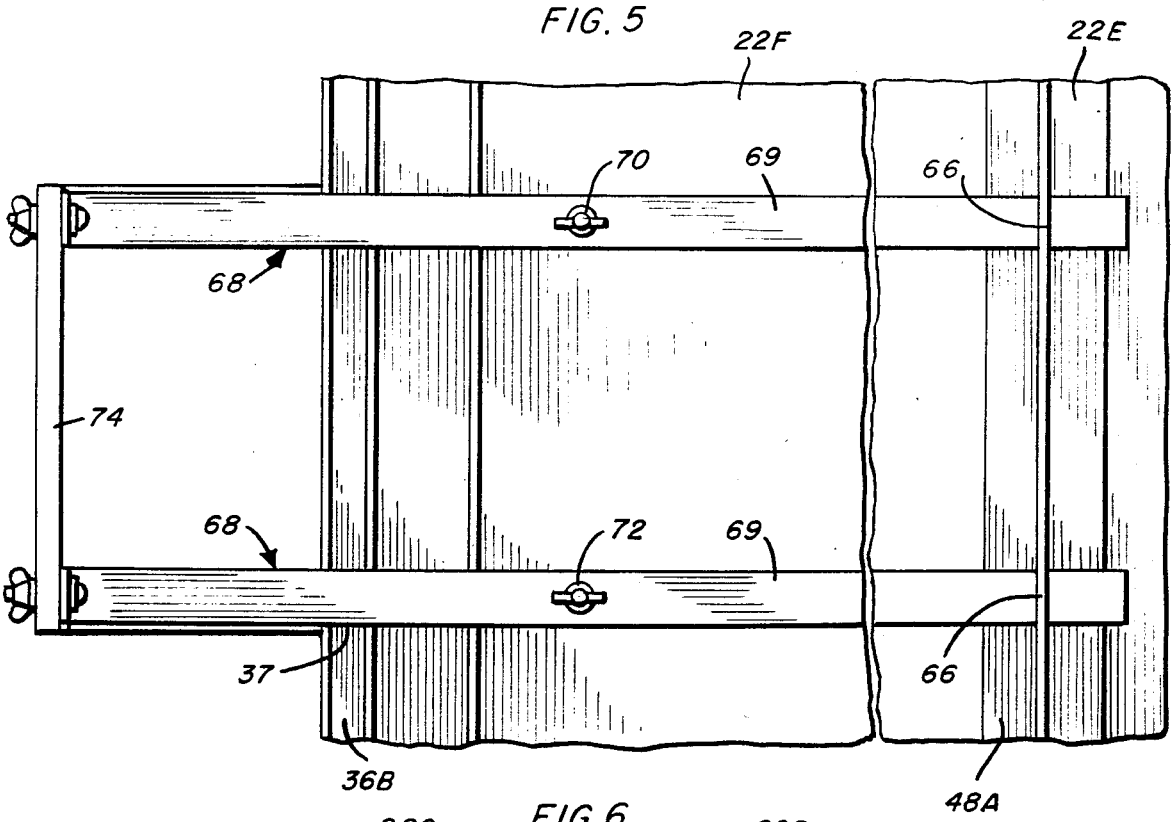
FIG. 5 is a bottom view of the structure of FIG. 4.

Support 48A as shown in FIGS. 4 and 5 between the rearmost deck panels 22E and 22F at the stern of the boat where the motor is to be attached, includes retaining slots 66 formed through its strengthening rib for slidably receiving motor mount supports 68, in the nature of a pair of elongated beams 69 bolted at 70 and 72 to deck panel 22F. The motor mount is completed by a mounting board 74 rigid with the outer ends of the beams and projecting vertically therefrom to accommodate an outboard motor (not shown). If desired, appropriate diagonal bracing can be used between the supports 68 and the upper portion of board 74.

Pontoon member 76 is an inflatable sack, generally composed of a rubberized fabric or a strong polymer material such as Kevlar®, a woven polyamide. For added safety, each pontoon may comprise two or more independently inflatable sections, in order to minimize the effect of failure of one section. At each end of each pontoon is a D-ring 78 for anchoring the assembled boat to the dock. The pontoons are positioned longitudinally beneath the opposed sides of the asembled deck. Each pontoon includes an outside flap 80 extending along at least a major portion of the length thereof. Noting FIGS. 3 and 8, this flap 80 includes spaced slots 82 which fit over a series of laterally extending turnbuttons 84 on the overlying side rails 34A–34D for attaching the pontoons to the side rails. The pontoons also have a series of inside flaps 86, each flap having a snap 88. Each of the flaps 86 is located to correspond to either a support member 48 or an end rail 36A–36B, each support member 48 and end rail 36A–36B being provided with a complementary snap 90 for snap-locking of the flaps 86 to the deck structure. These snaps are constructed of a non-rusting material such as brass. In such manner, the flaps 86 are attached to the support members and end rails to complete assembly of the deck section to the pontoons. As will be best noted in FIG. 3, the depending rigidifying rib of each support 48 terminates short of the sides of the deck structure to avoid engagement thereof with the pontoons.

The boat further includes hand rails vertically aligned with the side rails 34A–34D and defined by sections 92, shown in FIGS. 3 and 12. The hand rail sections 92 include an upward facing channel 94 with inwardly directed lips, a downward facing channel 96, and a downwardly directed bead slot 98 along the outer side thereof. The hand rail sections 92 are attached to the side rail sections 34A–34D by means of pickets 100 which are received in channels 96 and pivotally secured at one end to swing downwardly for insertion of the lower ends into sockets and picket retaining slides 102 which are attached to the side rails through tongue structures 104 and 106 received in channels 42 and 44. The slides 102 are similar to center connector 52 in that they include a block body and tongue structures, and may be slid along channels 42 and 44 to any point along the rail. Slides 102 are secured by means of thumbscrews 108 threaded therethrough which abut vertical support 38 between channels 42 and 44. The opposed ends of the hand rails can be braced by diagonal end struts 110 pivoted to and unfolded from end rails 36 for attachment to the ends of hand rails 92. When two hand rail sections are used on each side of the boat, the hand rail sections on each side are fastened together by hand rail connectors 112 which slide in top channels 94 and bridge the adjacent ends of hand rail sections. Hand rail connectors 112 are secured in channels 94 by means of thumbscrews 114 which are threaded through the hand rail connectors and abut channels 94. Additional stability in the hand rails may be obtained by the use of diagonal side struts 116 between a side rail on each side of the boat and one of the overlying hand rail sections.

Side panels 118, which are preferably made of canvas, depend from upper edge beads received in bead slot 98 and are fastened along the lower edges by means of cooperating snaps 120 and 122 on the panels and the outside of side rails 34A–34D therebelow.

To secure canopy 124 onto the boat, a pair of centrally located frames 125 is provided, each frame including a pair of uprights or supports 126 which pass through retaining rings 128 projecting inwardly from the hand rails 92 and which are secured in sockets of additional slides 102 or sockets provided in center connectors 52 in the side rails. Each support 126 is provided with a diagonally pivoting canopy arm 130 which extends upwardly toward the front or the rear of the canopy. Supports 126 on opposite sides of the boat are interconnected by means of cross arms 132 which fit into the upper ends of the corresponding supports 126. Each of the cross arms 132 is provided with a series of tabs 134, each tab including a snap 136. The canopy fabric 124 includes a series of snaps 138 each of which corresponds to a snap 136. The canopy is attached by mating snaps 136 and 138 thus securing the canopy to the cross arms, and then end cross arms 140 which are located in a pocket at the ends of the canopy, are secured in canopy arms 130. Each corner of the canopy is then secured either to the hand rail or to the side rail by means of hold-down straps 142. For safety, a rope or chain 144 may be fastened between the hand rails at the front and rear ends of the boat.

If desired, the forward pair of opposite hand rails 92B may be omitted to leave the front end of the boat completely open, for example, for fishing. For scuba diving, it may be desirable to omit all hand rails.

In order to facilitate assembly of the boat, the various fastening and retaining means have been designed so that no tools are necessary for connection of the parts. As noted, the flaps 80 and 86 attach by means of turn buttons or snaps, and the side panels 118 and canopy 124 attach by means of snaps. The side rail connectors 52 attach to the side rails by tongue and groove means and are secured with thumb screws. The retainers on the side rails for the pickets and for the canopy uprights consist of sockets formed in center connector 52 or a similar slide 102. The motor supports arms 68 fasten to the deck panels by means of screws and wing nuts.

As suggested in the phantom showing in FIG. 5, the motor supports are reversible with mounting board 74 directed upwardly for use with long shaft motors and downwardly for use with short shaft motors.

The preferred method for assembling the boat will now be described.

Figures 7, 8, 9:
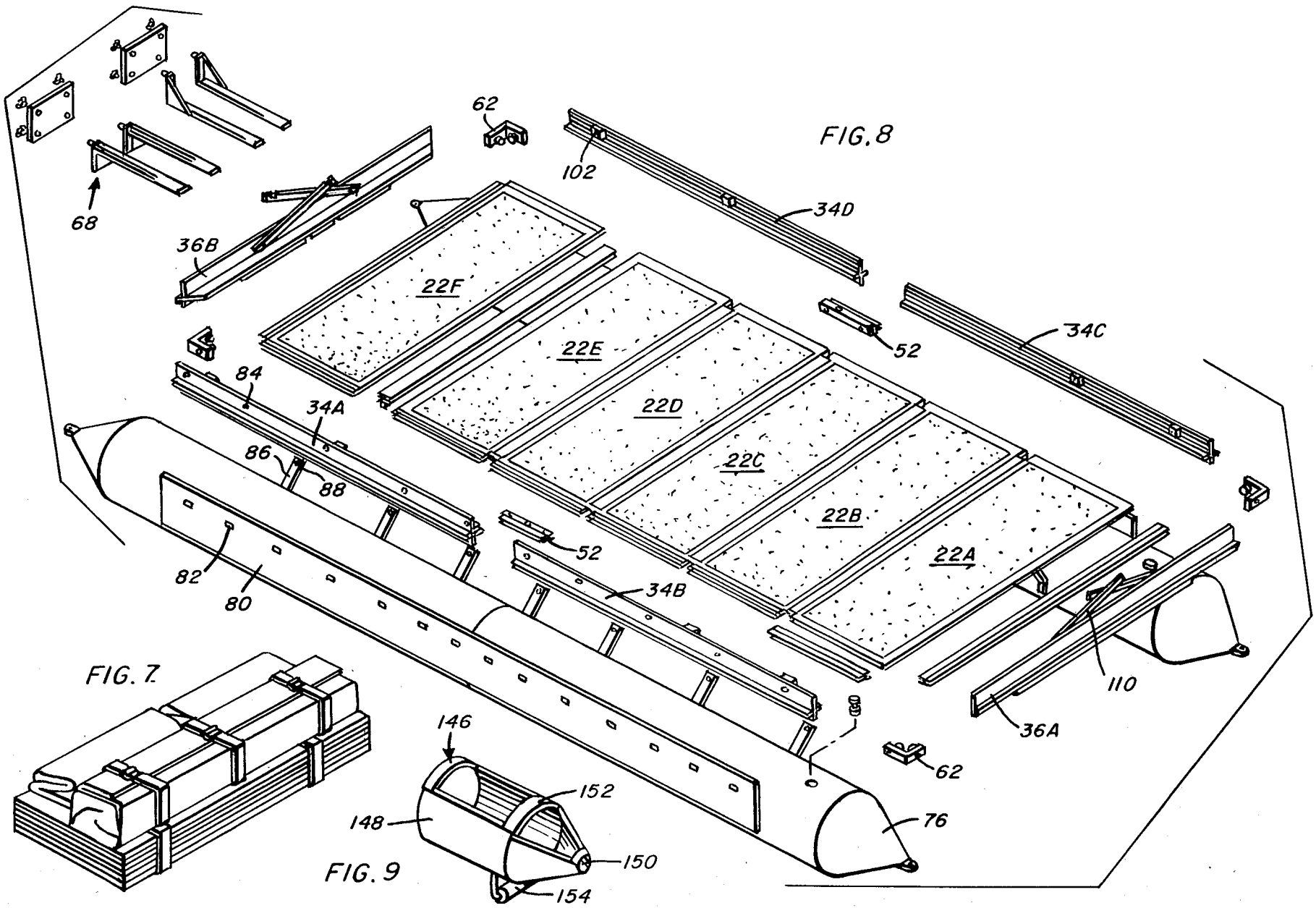
FIG. 7 is a perspective view of the boat disassembled and packed for transport.
FIG. 8 is an exploded perspective view of the deck and pontoon sections of a boat according to the invention.
FIG. 9 is a perspective view of a boot which protects a pontoon.

A place to assemble the boat which is as level as possible and close to the water should be chosen. The boat package or kit shown in FIG. 7, is broken down, and pontoons 76, deck panels 22A–22F, side rails 34A–34D, end rails 36A–36B and supports 48 are laid out on the ground and oriented to correspond generally to their final assembly position as shown in FIG. 8. The pontoons may then be inflated using a manual or electric pump, typically to a maximum pressure of three pounds. If the weather is very hot or the unit is to be used in the sun for a long period of time, the pontoons will be inflated only to 2 to 2½ pounds of pressure to accommodate expansion of the air in the pontoons. The deck is assembled next. End rail 36A is first mated with the first deck panel 22A and corner connectors 62 are secured at the ends of channel 44 of end rail 36A. The deck panel is then turned on its edge and channels 40 of side rails 34B and 34C are slid down over tongue portions 32 of members 28 of deck panel 22A, with channels 44 of side rails 34B and 34C being slid down over corner connectors 62 which are secured with thumbscrews 64. With two adjacent corners now secure, the remainder of the deck may be assembled in an upright position or on the ground. Support 48 is received over edge protector 26 on deck panel 22A with the rib side down. Then the second deck panel 22B is slid into the channel 50 of the positioned support 48 with extrusion 26 mating with channel 50. Another support 48 is then slid into place at the other side of deck panel 22B. When deck panels have been placed along the entire length of the first pair of parallel side rails 34B and 34C, an additional side rail 34A or 34D may be attached to each first rail by sliding connector 52 through grooves 42 and 44 to a position bridging two rails, and tightening thumbscrews 60 to lock connector 52 in place. The further deck panels and supports are then slid into place. The final deck panel 22F including end rail 36B and two corner connectors 62 secured in channel 44 of the end rail 36B is then slid into place. When the final deck panel 22F is in place, the corner connectors 62 are secured against side rails 34A and 34D by tightening thumbscrews 64, and the deck is complete. The motor mount is now assembled by attaching motor mount beams 68 to motor mount board 74. The motor mount beams 68 fit into slots 37 provided in the under side of end rail 36B, and slide into slots 66 provided in the last support 48A. Attaching bolts are then used to fasten the motor mount beams 68 to the last deck panel 22F at 70 and 72 using wing nuts.

In order to attach the pontoons 76 to the deck, the deck section is turned so that its bottom side faces up. Each inflated pontoon is next placed over the deck and then, starting in the center, the outside flap 80 is attached to turn buttons 84 through slots 82. After the flap is attached to the side rail 34A–34D, the flap 86 are attached via snaps 88 to snaps 90 located on the bottom of supports 48 and end rails 36A and 36B, starting from the center and working towards the ends. This procedure used for both pontoons.

The hand rail sections 92 are then attached to the deck by pivoting down the pickets 100 from channels 96 and inserting the lower ends thereof into picket retaining slides 102 or sockets provided in center connector 52. The bottoms of pickets 100 should touch the deck for stability. The fabric side panels 118 are then depended from bead slots 98 and secured to the outside of side rails 34A–34D via snaps 120 and 122. To complete the securing of the hand rail, support struts 116 are pivoted upwardly from the end rails 36A and 36B and attached to the outer ends of the hand rail sections 92. After all hand rails have been attached and the hand rail connectors 112 have been slid to the center of the aligned rails and secured in place by tightening thumb screws 114, side support struts may be fastened to side rails 34B and 34C and hand rails 92.

The canopy 124 is next attached by placing uprights 126 through hand rail retaining means rings 128 and into side rail retaining slides 102 or center connectors 52. Cross arms 132 are then attached to opposite pairs of uprights 126 and canopy 124 is attached to the cross arms by means of snaps 136 and 138. End cross arms 140 are then attached to canopy arms 130, and canopy securing or hold-down straps 142 are used to secure the corners of the canopy to the hand rails or side rails in order to prevent wind damage to the canopy.

Front and rear safety rail ropes 144 are then attached to the front and rear hand rails and a mooring line (not shown) is attached to one of the D-rings 78 so that the boat will not drift away after it is launched. The boat is launched by placing the bow of the boat in the water and the stern of the boat is picked up and the boat slid into the water with the mooring line secured to the shore. With the boat in the water the motor may be attached to the motor mount board.

Advantageously, a set of removable boots 146 as shown in FIG. 9, may be used to protect the ends of the pontoon during launching. These boots each include an upwardly directed cradle 148 with a conical leading end 150 generally conforming to the pontoon end, and overlying retaining straps 152. A transversely mounted roller 154 is bracket-mounted beneath boot 146 for ease in transporting the boat on land.

The boat as described is highly advantageous in that it may be assembled quickly and easily in a few minutes without tools. Similarly, the boat may be disassembled quickly, by reversing the assembly steps. Further, the length of the boat can be changed by utilizing more or fewer deck panels and side rails. The boat as described is lightweight, yet rigid. As an example, utilizing aluminum extrusions, a boat with a 6′ by 12′ deck can be assembled which weighs less than 200 pounds, including two 17′ pontoons. Modifications to the structure as described above may of course be made within the purview of the present invention.

What is claimed is:

1. A collapsible pontoon boat comprising:

a deck assembly;

a plurality of inflatable pontoons for receiving and supporting said deck assembly;

said deck assembly including a plurality of deck panels, end rails and side rails assemblable into a deck frame for receiving said deck panels in generally coplanar adjacent relation to each other, a support member positionable between adjacent deck panels, means for securing the deck panels to the side rails and end rails, and means for securing said pontoons to the deck assembly in underlying relationship to the deck immediately adjacent the side rails;

said means for securing said pontoons to the deck assembly including at least one outside flap attached to and extending over at least a major portion of the outside face of the pontoon, which flap includes fastener means, and cooperating fastener means provided on the outside of each side rail.

2. The collapsible pontoon boat as in claim 1, wherein the means for securing the deck panels to the side rails and end rails comprise cooperating tongue and groove means on said panels and rails.

3. The collapsible pontoon boat as in claim 1, wherein said fastener means and cooperating fastener means comprise turn buttons and slots.

4. The collapsible pontoon boat as in claim 1, wherein means securing said pontoons further includes a plurality of inside flaps attached to and extending along the inside face of each pontoon, said flaps being adapted for connection to a portion of the underside of the deck assembly inward of the side rails.

5. The collapsible pontoon boat as in claim 4, wherein said inside flaps are alignable with the end rails and support members, and include means for attachment to said end rails and support members.

6. The collapsible pontoon boat as in claim 5, wherein said means for attachment comprises cooperating snap fasteners.

7. The collapsible pontoon boat as in claim 1, wherein each support member is in the shape of an I-beam.

8. The collapsible pontoon boat as in claim 1 additionally comprising a canopy, and means for removably mounting said canopy over the deck assembly.

9. The collapsible pontoon boat as in claim 8, wherein said canopy mounting means comprises a frame including at least two pairs of uprights, each pair disposable on opposite sides of the boat, cross-arms engageable between each pair of uprights, four canopy arms each extendable diagonally from first outer ends at corners of the canopy to uprights on the corresponding side of the boat, means for attaching the canopy to the cross-arms, and means for attaching the canopy to the canopy arms.

10. A collapsible pontoon boat comprising:

a deck assembly;

a plurality of inflatable pontoons for receiving and supporting said deck assembly;

said deck assembly including a plurality of deck panels, end rails and side rails assemblable into a deck frame for receiving said deck panels in generally coplanar adjacent relation to each other, a support member positionable between adjacent deck panels, means for securing the deck panels to the side rails and end rails, and means for securing said pontoons to the deck assembly in underlying relationship to the deck immediately adjacent the side rails;

hand rail means positionable in overlying spaced relation to each side rail;

pickets pivotally attached to each hand rail and selectively downwardly pivotable therefrom; and picket retaining means mountable on said side rails.

11. The collapsible pontoon boat as in claim 10, wherein each hand rail means comprises a pair of hand rail sections formed in a generally H-shape, presenting an upward facing channel and a downward facing channel, said pickets being pivotally attached within said downwardly facing channel.

12. The collapsible pontoon boat as in claim 11, including connector means receivable within said upwardly facing channel of adjacent ends of a pair of hand rail sections which comprise each hand rail means.

13. The collapsible pontoon boat as in claim 10, additionally comprising a pair of end struts pivotally attached to one of said end rails and having remote ends engageable with selected hand rail sections.

14. The collapsible pontoon boat as in claim 10, additionally comprising side struts pivotally attached to selected hand rail sections and extendable diagonally downwardly for attachment to an underlying side rail.

15. The collapsible pontoon boat as in claim 10, wherein the means for securing the deck panels to the side rails and end rails comprise cooperating tongue and groove means on said panels and rails.

16. The collapsible pontoon boat as in claim 10, wherein each support member is in the shape of an I-beam.

17. The collapsible pontoon boat as in claim 10, additionally comprising a canopy, and means for removably mounting said canopy over the deck assembly.

18. The collapsible pontoon boat as in claim 17, wherein said canopy mounting means comprises a frame including at least two pairs of uprights, each pair disposable on opposite sides of the boat, cross-arms engageable between each pair of uprights, four canopy arms each extendable diagonally from first outer ends at corners of the canopy to uprights on the corresponding side of the boat, means for attaching the canopy to the cross-arms, and means for attaching the canopy to the canopy arms.

19. A collapsible pontoon boat comprising:

a deck assembly;

a plurality of inflatable pontoons for receiving and supporting said deck assembly;

said deck assembly including a plurality of deck panels, end rails and side rails assemblable into a deck frame for receiving said deck panels in generally coplanar adjacent relation to each other, a support member positionable between adjacent deck panels, means for securing the deck panels to the side rails and end rails, and means for securing said pontoons to the deck assembly in underlying relationship to the deck immediately adjacent the side rails;

a canopy; and means for removably mounting said canopy over the deck assembly, comprising a frame including at least two pairs of uprights, each pair disposable on opposite sides of the boat, cross-arms engageable between each pair of uprights, four canopy arms each extendable diagonally from first outer ends at corners of the canopy to uprights on the corresponding side of the boat, means for attaching the canopy to the cross-arms, and means for attaching the canopy to the canopy arms;

wherein said cross-arms have flaps attached thereto and the means for attaching the canopy to the cross-arms comprises snaps provided on the canopy and corresponding snaps provided on the flaps attached to the cross-arms.

20. The collapsible pontoon boat as in claim 19, including cross-arms engageable between selected outer ends of the canopy arms, and wherein the means for attaching the canopy to the canopy arms comprises pockets at the ends of the canopy which receive the cross-arms engageable with the canopy arms.

21. The collapsible pontoon boat as in claim 19, wherein the means for securing the deck panels to the side rails and end rails comprise cooperating tongue and groove means on said panels and rails.

22. The collapsible pontoon boat as in claim 19, wherein each support member is in the shape of an I-beam.

* * * * *